US010814938B2

(12) United States Patent
Daran et al.

(10) Patent No.: US 10,814,938 B2
(45) Date of Patent: Oct. 27, 2020

(54) TURRET MOORING BUOY SYSTEM

(71) Applicant: SINGLE BUOY MOORINGS INC., Marly (CH)

(72) Inventors: Renaud Daran, Bât. Aigue Marine (MC); Xavier Schut, Bât. Aigue Marine (MC); Christian Raymond Bauduin, Bât. Aigue Marine (MC)

(73) Assignee: SINGLE BUOY MOORINGS INC., Marly (CH)

( * ) Notice: Subject to any disclaimer, the term of this patent is extended or adjusted under 35 U.S.C. 154(b) by 0 days.

(21) Appl. No.: 16/620,604

(22) PCT Filed: Jun. 21, 2018

(86) PCT No.: PCT/EP2018/066637
§ 371 (c)(1),
(2) Date: Dec. 9, 2019

(87) PCT Pub. No.: WO2018/234487
PCT Pub. Date: Dec. 27, 2018

(65) Prior Publication Data

US 2020/0198737 A1 Jun. 25, 2020

(30) Foreign Application Priority Data

Jun. 22, 2017 (EP) ..... 17177476

(51) Int. Cl.
*B63B 21/04* (2006.01)
*B63B 21/50* (2006.01)

(52) U.S. Cl.
CPC ..... *B63B 21/508* (2013.01)

(58) Field of Classification Search
CPC .... B63B 21/508; B63B 21/021; B63B 21/026
See application file for complete search history.

(56) References Cited

U.S. PATENT DOCUMENTS 4,321,720 A * 3/1982 Havre ..... B63B 22/021 441/5
4,637,336 A * 1/1987 Engelskirchen ..... B63B 22/021 114/293

(Continued)

FOREIGN PATENT DOCUMENTS

AU 2015200739 A1 3/2015
EP 2303680 A2 4/2011

(Continued)

OTHER PUBLICATIONS

International Search Report, dated Sep. 11, 2018, from corresponding PCT application No. PCT/EP2018/066637.

*Primary Examiner* — Benjamin F Fiorello
(74) *Attorney, Agent, or Firm* — Nixon & Vanderhye

(57) ABSTRACT

A mooring buoy system releasably connects risers and anchor lines to a turret of a floating structure, and includes: a buoyant body carrying the risers, which extend to a subsea hydrocarbon well; anchor line connectors, for connecting anchor lines to the buoyant body, each anchor line having one end connected to a connector and the opposing end to the seabed; and a reconnection wire running through a channel coinciding with a center line of the buoyant body, connectable to each anchor line below the buoyant body at some distance from the anchor line connectors through anchor line connection sections on one end and includes a stopper and winch wire connection arrangement on the other end. Also disclosed is a method for pulling up risers and anchor lines, for releasably attaching the risers and anchor lines, as well as a method for constructing a mooring buoy.

14 Claims, 5 Drawing Sheets

(56) References Cited

U.S. PATENT DOCUMENTS

| | | | | | |
|---|---|---|---|---|---|
| 4,892,495 | A * | 1/1990 | Svensen | B63B 21/508 | 441/5 |
| 5,356,321 | A * | 10/1994 | Boatman | B63B 21/508 | 114/230.12 |
| 5,860,840 | A * | 1/1999 | Boatman | B63B 21/508 | 441/5 |
| 6,003,603 | A * | 12/1999 | Breivik | B63B 21/508 | 166/357 |
| 7,717,762 | B2 * | 5/2010 | Boatman | B63B 21/508 | 114/230.1 |
| 8,851,004 | B2 * | 10/2014 | Lavagna | B63B 21/508 | 114/230.12 |
| 9,534,716 | B2 * | 1/2017 | Randrianarivony | F16L 37/62 | |
| 2002/0117098 | A1 * | 8/2002 | Boatman | B63B 21/508 | 114/230.12 |
| 2007/0155259 | A1 * | 7/2007 | Van Tol | B63B 22/026 | 441/3 |
| 2011/0092115 | A1 * | 4/2011 | Braud | B63B 21/508 | 441/3 |
| 2012/0216736 | A1 * | 8/2012 | Heideman | B63B 21/508 | 114/125 |
| 2015/0314835 | A1 * | 11/2015 | Carrico | B63B 21/508 | 114/230.12 |

FOREIGN PATENT DOCUMENTS

| | | | |
|---|---|---|---|
| EP | 2492183 | A1 | 8/2012 |
| GB | 2150964 | B | 10/1987 |
| NL | 8403567 | A | 7/1985 |
| WO | 2009/141351 | A2 | 11/2009 |

* cited by examiner

TURRET MOORING BUOY SYSTEM

FIELD OF THE INVENTION

The present invention relates to a mooring buoy system for releasably connecting one or more risers and mooring lines to a floating structure, such as a vessel, in particular an offshore vessel with an internal or external turret mooring system, as well as a method for connecting mooring lines to a floating structure.

BACKGROUND

A reconnection arrangement normally consists of a reconnection winch wire connected to a buoy. In order to reconnect the buoy to a turret of an offshore vessel, a winch pulls-in the winch wire to bring the buoy to the vessel until it is in a final lock position. In this arrangement, the winch wire is designed to sustain a mean load corresponding to the mean load expected during the buoy pull-in, which is the delta of the suspended weight between connected and disconnected drafts. The suspended weight is the combined weight of one or more risers and anchor lines hanging off from the buoyant body. In addition to the main load, the winch sustains dynamic loads corresponding to inertia forces induced by relative vessel-buoy motions. Depending on the maximum reconnection sea-state, the dynamic loads may generate snatch loads and very high peak loads on the winch. In order to reduce these loads, a heave compensator system may be introduced to reduce the peak load and thereby the required winch capacity. The drawback of such a tool is the complexity of such an arrangement and the space/volume required on the turret manifold.

EP 2492183 A1 discloses a disconnectable mooring system. The known system includes a buoy that is provided with a conical outer casing and a corresponding conical buoy receptacle on the lower end of the vessel's turret structure, for detachably receiving the buoy member. The mooring system further comprises a plurality of mooring lines for transmitting mooring forces that each have a lower end and an upper end connected to the seabed and the buoy member, respectively. In this publication it is shown that the mooring lines each comprise a first section and a second section connected to the first section at a coupling point and connected to the buoy member. The length of the second section between said coupling point and its connection to the buoy member is chosen such that when the buoy member is received in the buoy receptacle with the first section connected to the turret structure and in a state for transmitting mooring forces, said second section is in a slack state not loaded by said mooring forces. This configuration removes the dynamic loads generated due to relative vessel-buoy motions while the vessel is moored, however, it does not remove the need for a high capacity winch and/or heave compensation system to be used during (dis)connection operations.

An alternative disconnectable mooring buoy systems is disclosed by EP 2303680 A2. This system comprises a lifting device that is placed on the hull with a cable that extends through the cavity to a weight that is situated below a bottom of the vessel, a mooring buoy being attached to the cable, the mooring buoy carrying mooring lines that are connected to a sea bed and being receivable in the cavity for coupling with the vessel, the mooring buoy comprising a central shaft through which the cable passes, the buoy being movable relative to the cable in a length direction of the cable, which weight is located on the cable at or below the buoy, a stopper being provided on the cable for engaging with the buoy and for blocking relative movement of the buoy and the cable, the stopper being fixed to the cable near an upper or a lower end of the buoy.

The weight added to the buoy will cause the buoy to sink to a specific predetermined depth below the water surface upon disconnection from the vessel. Lifting the buoy towards the vessel is carried out via hauling in the weight suspended from the cable while allowing the buoy to rise by its own buoyancy towards the cavity for connection. By lifting only the weight that is suspended from the buoy without exerting a direct pulling force on the buoy, the buoy will rise to the surface due to its own buoyancy once the weight is lifted from the buoy via the hauling in the cable connected to a winch on the vessel. A disadvantage of this system is that, due to the weight added to the buoy, a larger buoy will be required for providing the required buoyancy in the disconnected situations.

It is an object of the present invention to provide a mooring buoy system, wherein the effects of the dynamic loads on the connection process are eliminated or at least minimized, thereby reducing the required winch size and removing the need for a heave compensation system.

It is a further object of the present invention to simplify and minimize the size of the equipment required for the disconnectable mooring of a floating structure.

SUMMARY OF THE INVENTION

The object is achieved by a mooring buoy system for releasably connecting one or more risers and anchor lines to a turret of a floating structure, wherein the buoy comprises: a buoyant body for carrying the one or more risers, which extend to a subsea hydrocarbon well; a number of anchor line connectors, for connecting a number of anchor lines to the buoyant body such that each anchor line has one end connected to one of the connectors and the opposing end is connected to the seabed; and a reconnection wire, wherein in an equilibrium state the buoyancy of the buoyant body (1) is equal to a mass of the buoyant body plus a suspended weight of the one or more risers (3) and a pulling force of the anchor lines, wherein the reconnection wire runs through a channel coinciding with a center line of the buoyant body, and is connectable to each of the anchor lines below the buoyant body at some distance from the anchor line connectors through anchor line connection sections on one end and comprises a stopper and winch wire connection arrangement on the other end, situated on the opposite side of the buoyant body from where the anchor line connectors are connectable.

An advantage of this configuration is that when a winch wire is connected to the reconnection wire through the winch wire connection arrangement and with the anchor lines connected on the opposing side of the reconnection wire, it will pull directly onto the anchor lines, bypassing the buoyant body via the reconnection wire running through this body. This will form the main loading path, limiting the effect of the dynamic loads introduced on the winch due to inertia effects and dynamic amplification caused by vessel-buoy motions.

Furthermore, the present invention only uses a simple buoyant body geometry without any additional added weight. This allows a minimum size buoy to be used required to keep the risers and anchor lines available for reconnection at a specific predetermined depth below the water surface.

In one embodiment, the anchor line connections are placed at a non-zero radial distance from the center line of the buoyant body. Ensuring the anchor lines are connected at the same radial distance results in a good stability of the buoy due to distributed anchor loads when the buoy is pulling onto the anchor lines. Additionally, this arrangement provides some clearance between the anchor lines and the reconnection wire, preventing them from becoming entangled.

In a preferred embodiment the length of the reconnection wire is such that it forms a slack when the stopper and winch wire connection arrangement is in contact with a side opposite of the side of the buoyant body where the anchor line connectors are connected. This results in a direct loading path for the anchoring loads onto the buoyant body when it is not being lifted up to a vessel.

Furthermore, the reconnection wire is connectable to the anchor lines at a distance from the anchor line connection to the buoyant body, such that, when connected, the anchor line section between the reconnection wire connection and the buoyant body is tension released when the reconnection wire is pulled up, thereby creating distance between the stopper and winch wire connection arrangement and the buoyant body. The buoyant body can move independent from the winch wire—anchor line combination within the length of the slack section of the anchor lines. As a result the dynamic loads introduced on the winch due to inertia effects and dynamic amplification caused by vessel-buoy motions are largely eliminated. The optimum winch capacity can be close to or equal to the minimum winch capacity required, which corresponds to the mean load expected during the buoy pull-in, without the use of a heave compensation system.

When the reconnection wire is connected to the anchor lines and under tension by the winch, the anchor lines exert a reduced force onto the buoyant body. The buoyant body is only carrying a reduced mooring force and one or more risers in this situation, and will start floating upwards due to its buoyancy, wherein the rise-up of the buoy is directly controlled by the winch wire pull-in velocity.

A preferred method for pulling up one or more risers and anchor lines, for releasably attaching the risers and anchor lines in a turret of a vessel's hull, comprises the steps of:

- attaching a winch wire from a vessel's turret mooring system to the reconnection wire of a mooring buoy system as described above, whereby the buoy is in an equilibrium state in which the buoyancy of the buoyant body (1) being equal to a mass of the buoyant body plus a suspended weight of the one or more risers (3) and a pulling force of the anchor lines;
- pulling in the winch wire, resulting in the reconnection wire pulling directly onto the anchor lines, through the center of the buoyant body, such that a section of the anchor lines between the reconnection wire connection and the anchor line connector becomes slack, reducing the suspended weight on the buoyant body;
- continued reeling in of the winch wire at a controllable or predetermined speed to keep the anchor line section between the reconnection wire connection and the anchor line connector slack and allow the buoyant body carrying the one or more risers to float upwards using the buoyancy of the buoyant body only.

Hereby, the velocity at which the winch wire is pulled in directly controls the rise-up of the buoy.

These steps can be followed by the following steps, which form a method for attaching the one or more risers in a turret of a vessel's hull:

- pulling up the one or more risers as described above, whereby the reeling in of the winch wire continues until the buoyant body is received in the turret structure;
- locking in of the buoyant body to the turret structure;
- releasing the reconnection wire, such that it forms a slack below the buoyant body where it is connected to the anchor lines and the slack is removed from the section of the anchor lines between the reconnection wire connection and the anchor line connector.

While the vessel is moored, the anchor forces are directed into the turret through the buoyant body. The winch wire can be detached from the reconnection wire, freeing up the winch for other uses on board the vessel.

A preferred method for manufacturing a mooring buoy for use in the pulling up and attachment method as described in the previous section comprises the steps of:

- providing a buoyant body, comprising a through channel coinciding with a center line of the buoyant body;
- installing a number of anchor line connectors on a transverse side to the through channel;
- installing one or more riser connectors on the side comprising the anchor line connectors;
- installing a reconnection wire through the through channel of the buoyant body, whereby the reconnection wire contains an equal number of wires to the number of anchor line connectors on the reconnection wire extremity exiting the buoyant body on the side having the anchor line connectors attached, and a stopper and winch wire connector is installed on the opposite extremity of the reconnection wire. Furthermore, the method may comprise the manufacturing of the buoyant body, comprising a through channel coinciding with a center line of the buoyant body. The amount and size of components used to construct this mooring buoy is comparable to those used for the construction of regular mooring buoys. Due to the minimum modifications required over constructing a regular buoy, the construction method can be done at similar cost and time.

BRIEF DESCRIPTION OF DRAWINGS

The invention will be explained in more detail below with reference to drawings in which illustrative embodiments thereof are shown. The drawings are intended exclusively for illustrative purposes and not as a restriction of the inventive concept. The scope of the invention is only limited by the definitions presented in the appended claims.

DETAILED DESCRIPTION OF EMBODIMENTS

Figure 1:
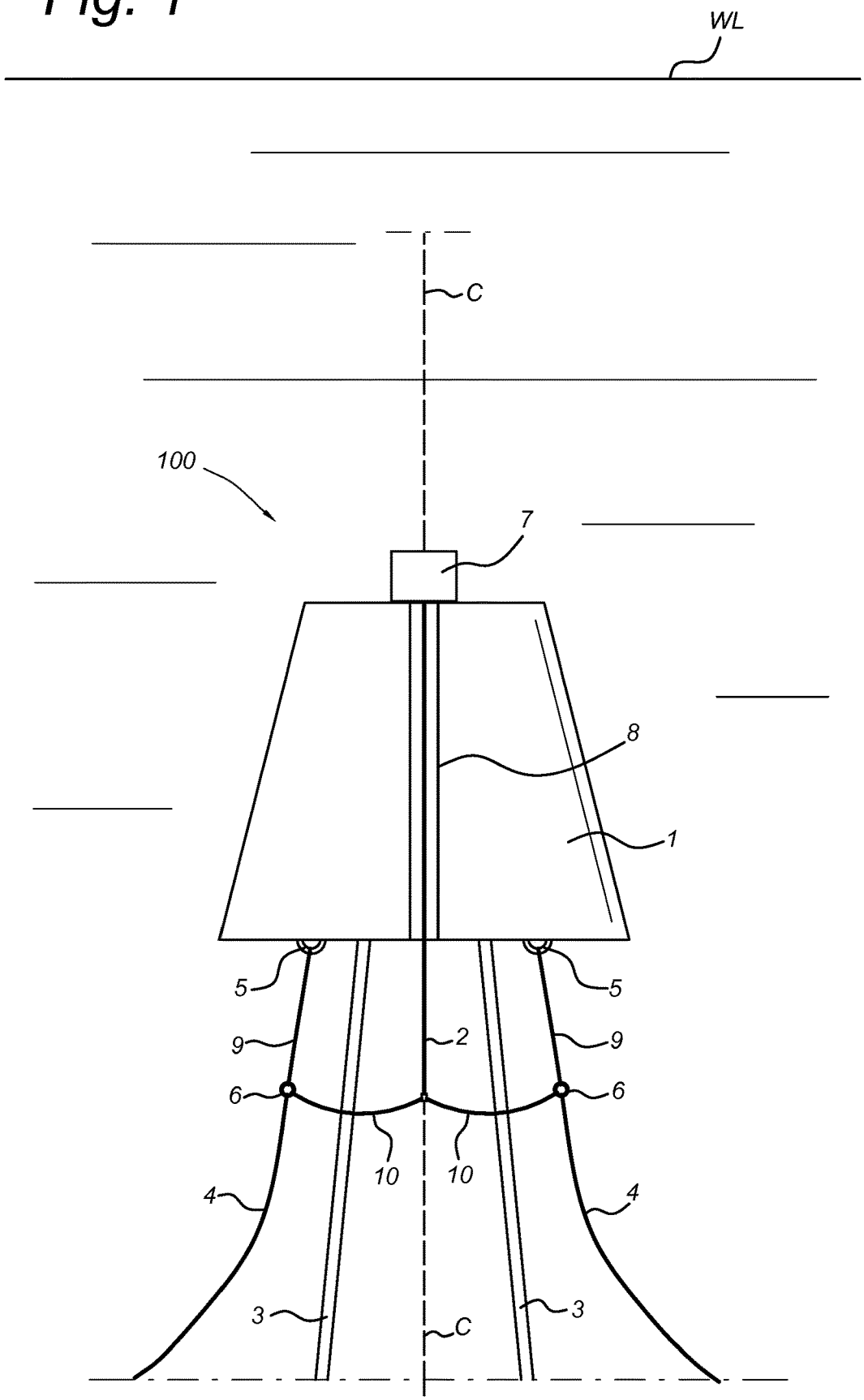
FIG. 1 shows a cross-section of the mooring buoy system in a submerged equilibrium state.

FIG. 1 shows a cross-section of the mooring buoy system in an equilibrium state, whereby the mooring buoy 100 comprises a buoyant body 1, anchor line connectors 5, and a reconnection wire. The reconnection wire comprises a main reconnection wire section 2 with reconnection wire anchor line connection sections 10 located on one end and a stopper and winch wire connection arrangement 7 located at the other end. The buoyant body 1 comprises a channel 8 running along a centerline C, providing a through-cavity from a top side to a bottom side through the buoyant body 1. The reconnection wire runs through this channel 8, such that the stopper and winch wire connection arrangement 7 is located on a top side of the buoyant body 1 and the anchor line connection section 10 is located at some distance from a bottom side of the buoyant body 1.

Furthermore the mooring buoy 100 is connected to one or more risers 3 and at the anchor line connectors 5 to anchor lines. The anchor lines each comprise a main anchor line section 4 with a shorter anchor line section 9 connected to it on one end. The anchor lines could be wires, lines or chains or a combination thereof made from metals and/or polymers.

The one or more risers 3 are connected to the buoyant body 1 at the bottom side.

The anchor line connections 5 are placed at a non-zero radial distance from the center line C of the buoyant body 1 on the same side as the one or more risers, i.e. the bottom side. This ensures the reconnection wire anchor connection sections 10 of the reconnection wire do not become entangled with the main reconnection wire 2, the anchor lines or the one or more risers 3. The anchor line connectors 5 and the riser connectors are spaced sufficiently apart and at a sufficient distance from the center line C where the main reconnection wire 2 is located.

The anchor lines are connected to the buoyant body 1 at the anchor line connectors through the free ends of the shorter anchor line sections 9.

The free ends of the anchor line connection sections 10 of the reconnection wire are attached to the anchor lines at connection point 6, at some distance below the buoyant body 1, where the main anchor line sections 4 connect to the shorter anchor line sections 9. The non-zero radial placement of the anchor line connectors from center line C, ensures the anchor line connection sections 10 of the reconnection wire and the shorter anchor line sections 9 to work in a manner that either one of the lines carries a substantial part, or preferably all, of the tension from the anchor lines.

In this equilibrium state, the stopper and winch wire connection arrangement 7 of the reconnection wire is resting on top of the buoyant body 1, such that the main reconnection wire section 2 extends some distance below the buoyant body 1. The reconnection wire anchor line connection sections 10 are slack, thus all mooring line loads pass through the anchor lines main and shorter line sections 4,9. The equilibrium exists due to the buoyancy of the buoyant body 1 being equal to the buoyant body mass plus the suspended weight of the one or more risers 3 and the pulling force of the anchor lines.

Figure 2:
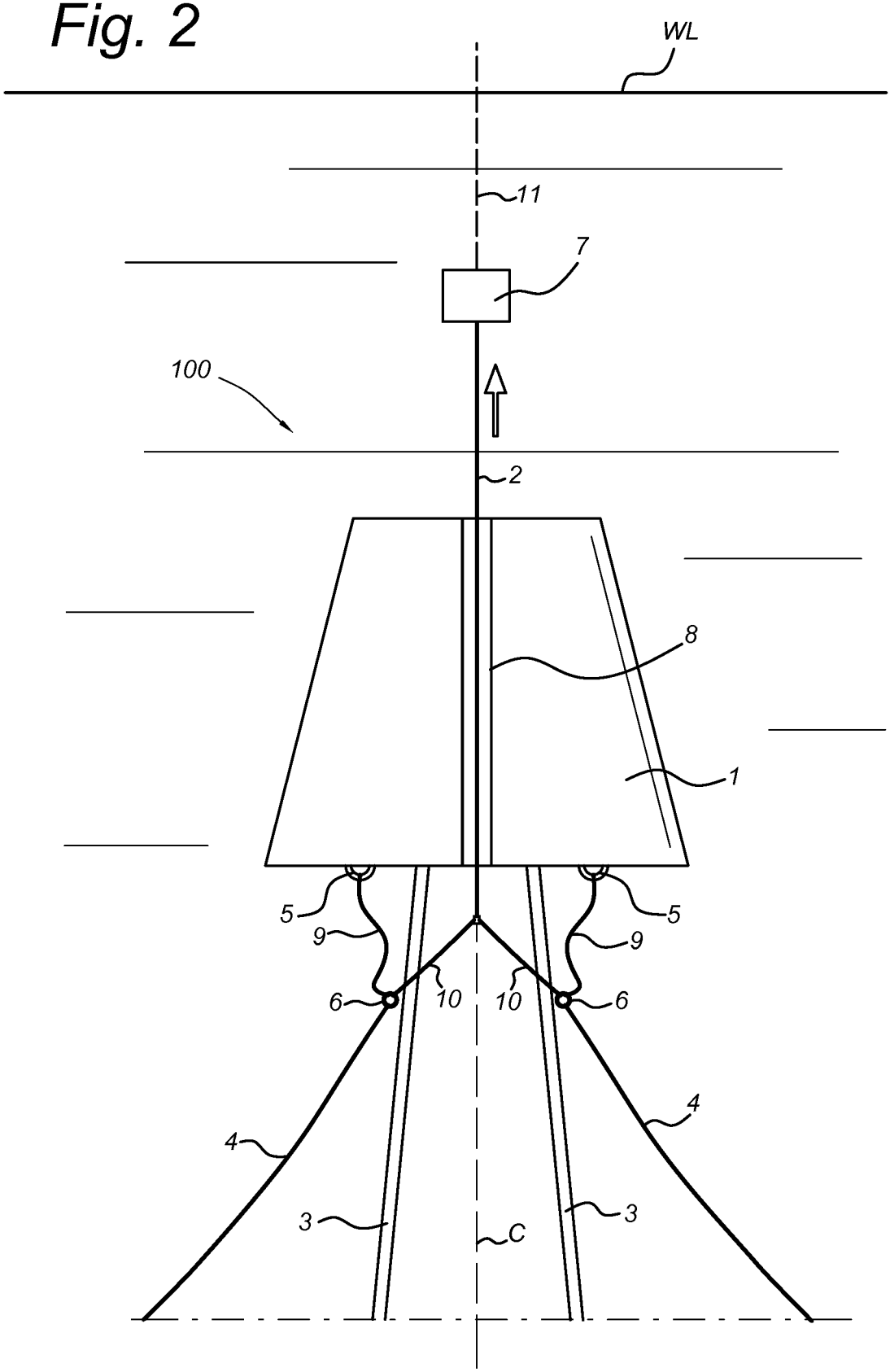
FIG. 2 shows a cross-section of the mooring buoy system in a buoy lifting state.

FIG. 2 shows a cross-section of the mooring buoy system in a buoy lifting state. In this state, a winch wire 11 is connected to the stopper and winch wire connection arrangement 7 of the mooring buoy 100 from FIG. 1. Engaging the winch wire 11 causes the stopper and winch wire connection arrangement 7 to be released from the top of the buoyant body 1 and the main reconnection wire section 2 to displace itself along the center line C with respect to the channel 8 of the buoyant body 1 such that the reconnection wire anchor line connection sections 10 on the opposite side of the buoyant body 1 are tensioned and the shorter anchor line sections 9 above the connection to the pull-up line are freed. As a result, the anchor line weight is removed from the force counteracting the buoyancy of the buoyant body 1, allowing the mooring buoy 100 to lift naturally to the surface.

Reeling in of the winch wire at a speed equal to the lifting speed of the buoy ensures the shorter anchor line sections 9 to remain slack, such that any heave motions of the mooring buoy 100 caused by the vessel motions are free from the winch wire 11 during lifting state. As a result the motions of the mooring buoy 100 and a vessel from which the winch is operated are decoupled and therefore the winch is not subject to inertia and dynamic loading anymore, allowing a safe connection in high sea-state.

Figure 3:
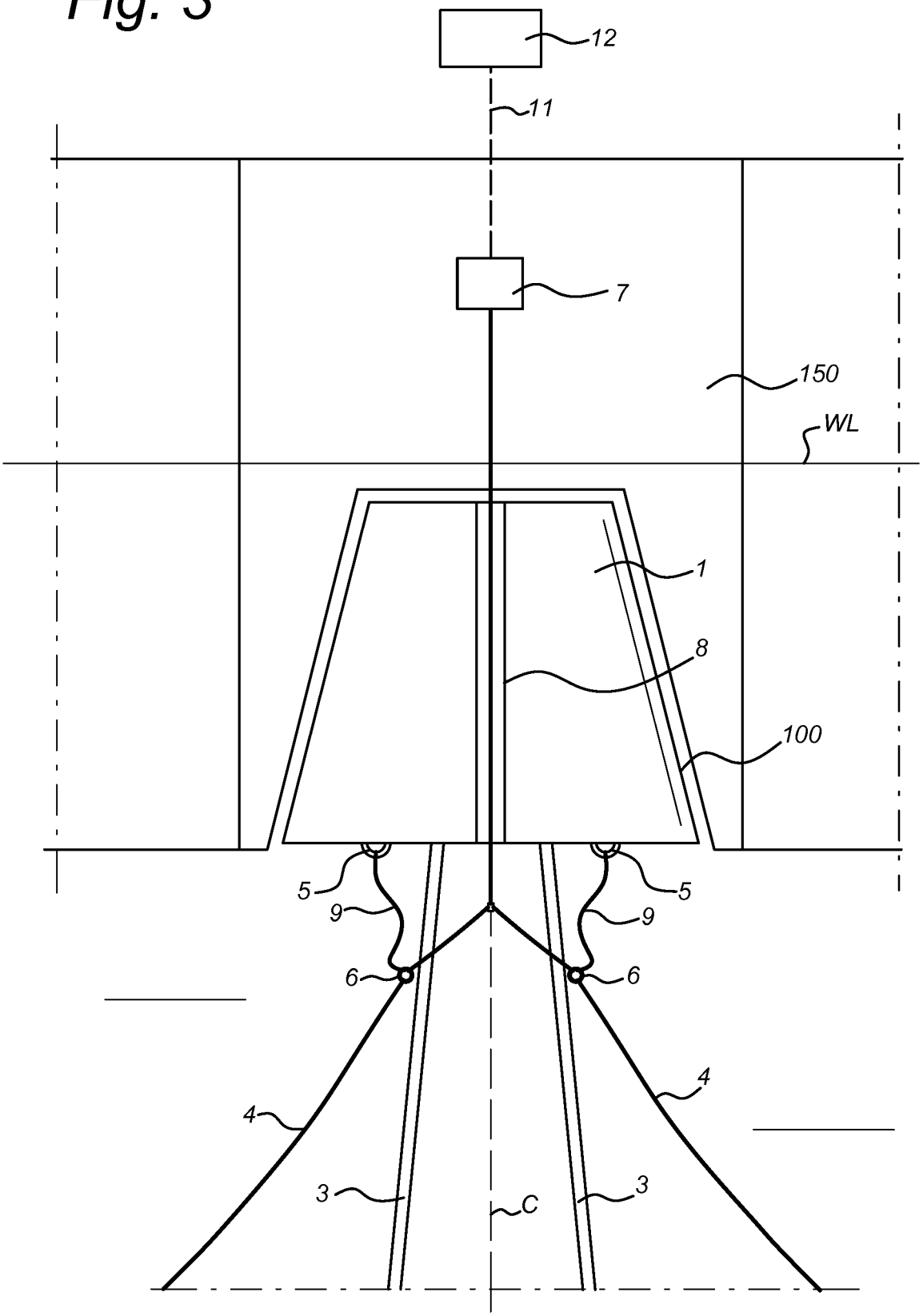
FIG. 3 shows a cross-section of the mooring buoy system in a buoy final lifting before connection state.

FIG. 3 shows a cross-section of the mooring buoy system in a buoy final lifting before connection state. Before reaching the water line WL, the mooring buoy 100 arrives in a cavity 110 of a turret 150 containing a winch 12 reeling in the winch wire 11. As long as the winch wire 11 remains engaged, the mooring buoy 100 remains in a lifting state, exerting a pull-up force onto the one or more risers 3 and the lifting motion of the mooring buoy only stopped by the turret 150.

The buoyant body 1 is then locked into the cavity 110 of the turret 150 and pull of the winch wire 11 is released from the stopper and winch wire connection arrangement 7.

Figure 4:
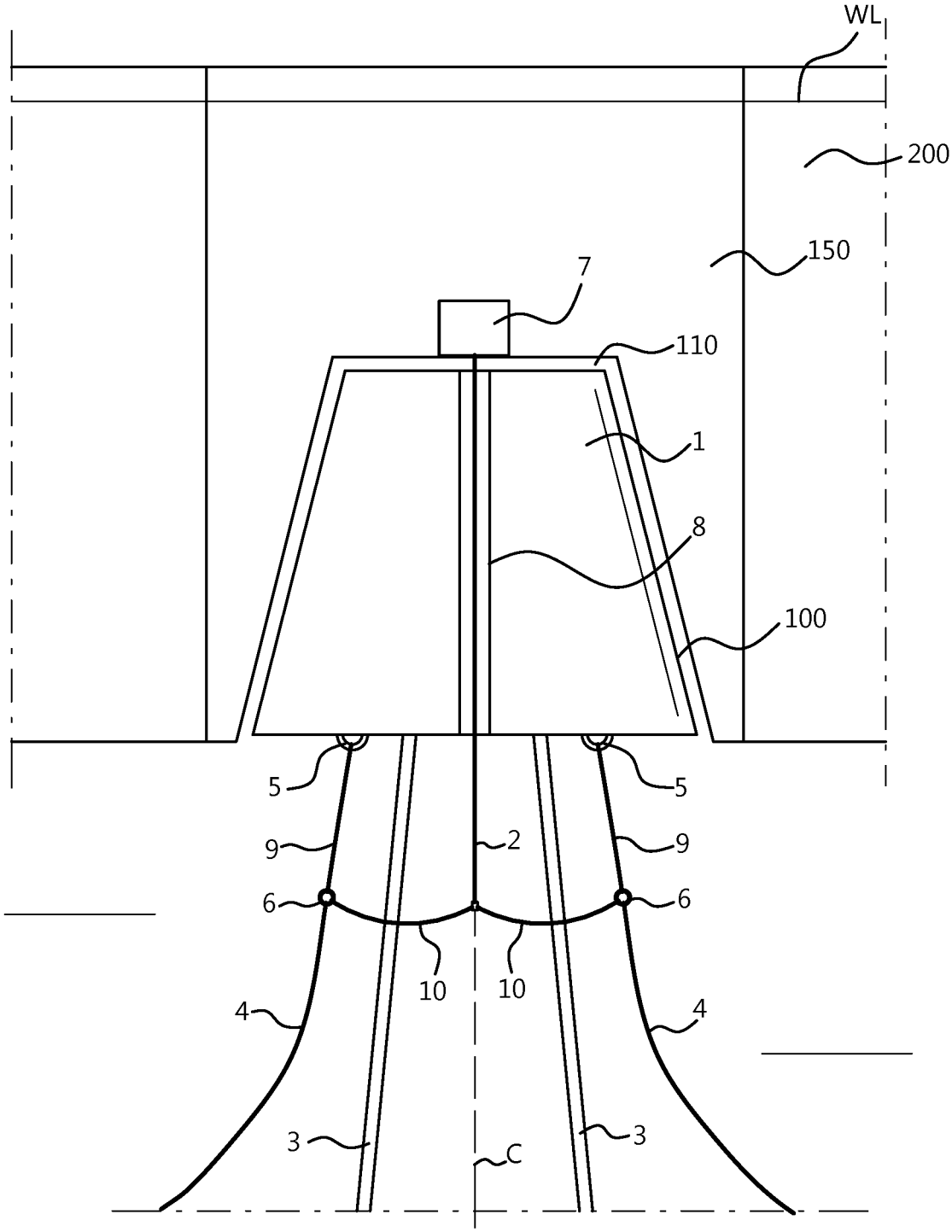
FIG. 4 shows a cross-section of the mooring buoy system in a connected state.

The resulting state is shown in FIG. 4, which shows a cross-section of the mooring buoy system with the mooring buoy 100 in a connected state to the vessel 200. The stopper and winch wire connection arrangement 7 is resting on top of the buoyant body 1, which again causes the main reconnection wire section 2 to extend some distance below the buoyant body 1 and the reconnection wire anchor line connection sections 10 to become slack. As a result all mooring line loads pass through the anchor lines main and shorter line sections 4,9. The buoyancy of the buoyant body 1 is less than the downward pulling force resulting from the anchor lines and suspended weight of the risers 3, causing a combined anchoring load to be transferred onto the turret 150.

Figure 5:
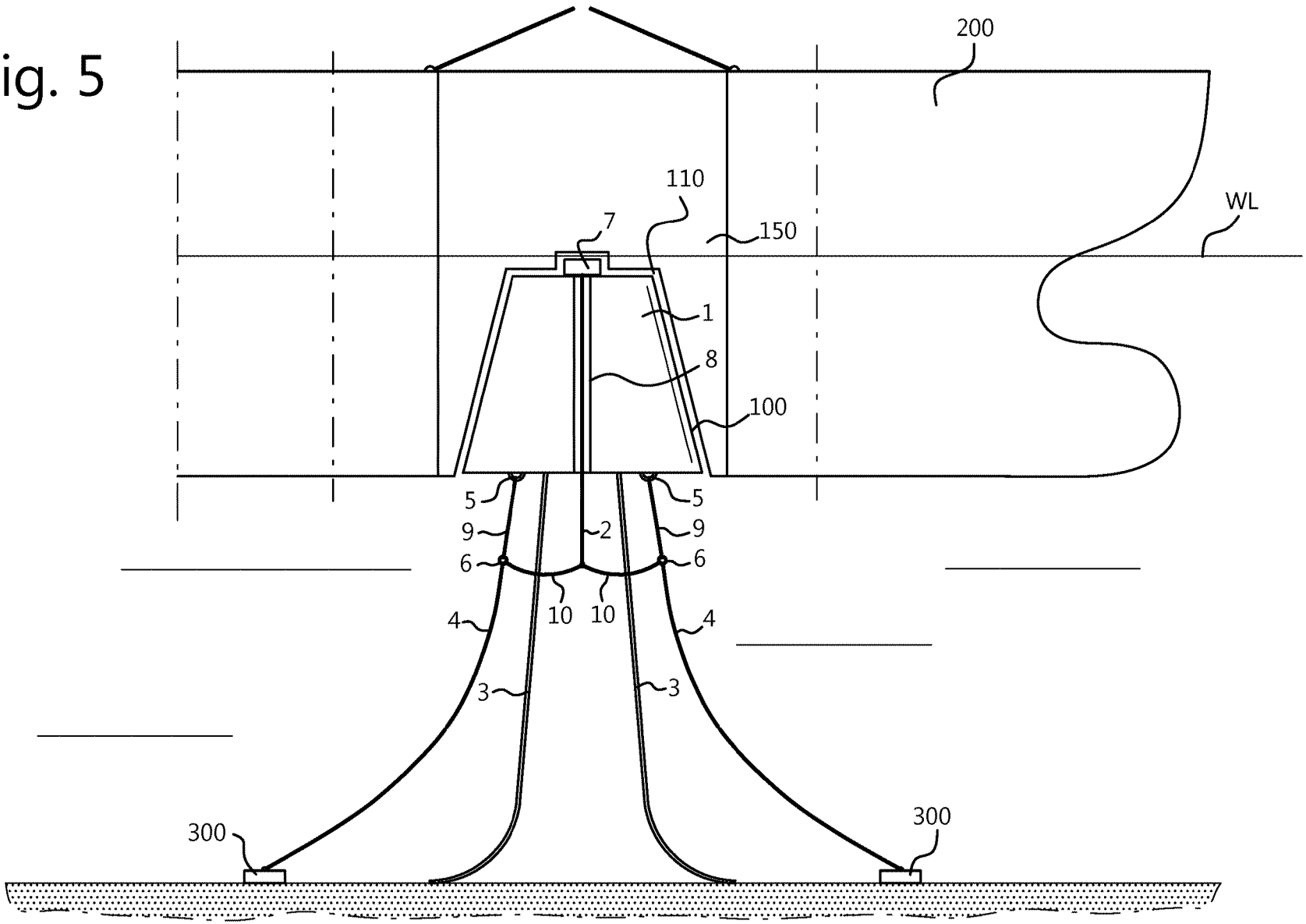
FIG. 5 shows a cross-section of a vessel for offshore operations and comprising a turret mooring system, moored using the mooring buoy system.

FIG. 5 shows a cross-section of part of a vessel 200 for offshore operations and comprising a turret mooring system, wherein the turret mooring system is connected to the anchor lines and one or more risers through the mooring buoy system.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims.

The invention claimed is:

1. A mooring buoy system for releasably connecting one or more risers and anchor lines to a turret of a floating structure, wherein the buoy comprises:

a buoyant body for carrying the one or more risers, which extend to a subsea hydrocarbon well;

a number of anchor line connectors, for connecting a number of anchor lines to the buoyant body such that each anchor line has one end connected to one of the connectors and the opposing end is connected to the seabed; and a reconnection wire, wherein in an equilibrium state the buoyancy of the buoyant body is equal to a mass of the buoyant body plus a suspended weight of the one or more risers and a pulling force of the anchor lines, wherein a main section of the reconnection wire runs through a channel coinciding with a center line of the buoyant body, and is connectable to each of the anchor lines below the buoyant body at some distance from the anchor line connectors through anchor line connection sections of the reconnection wire on one end and comprises a stopper and winch wire connection arrangement on the other end, situated on the opposite side of the buoyant body from where the anchor line connectors are located.

2. The mooring buoy system according to claim 1, wherein the anchor line connectors are at a non-zero radial distance from the center line of the buoyant body.

3. The mooring buoy system according to claim 2, wherein a length of the reconnection wire is such that the anchor line connector sections form a slack when the stopper and winch wire connection arrangement is in contact with a side opposite of the side of the buoyant body where the anchor line connectors are connected to anchor lines and the reconnection wire anchor line connection sections are attached to the respective anchor lines at a connection point.

4. The mooring buoy system according to claim 1, wherein a length of the reconnection wire is such that the anchor line connector sections form a slack when the stopper and winch wire connection arrangement is in contact with a side opposite of the side of the buoyant body where the anchor line connectors are connected to anchor lines and the reconnection wire anchor line connection sections are attached to the respective anchor lines at a connection point.

5. The mooring buoy system according to claim 1, wherein the reconnection wire is connectable to the anchor lines at a distance from the anchor line connection to the buoyant body, such that a short anchor line section, being the anchor line section between the connection point and the buoyant body, is tension released when the reconnection wire is pulled up, thereby creating distance between the stopper and winch wire connection arrangement and the buoyant body.

6. The mooring buoy system according to claim 5, wherein the release of tension on the anchor lines comprises the removal of the anchor line weight from the force counteracting the buoyancy so as to exert a reduced force onto the buoyant body.

7. A vessel for offshore operations and comprising a turret mooring system, wherein the turret mooring system is connected to the anchor lines and one or more risers through the mooring buoy system according to claim 1.

8. A method for pulling up one or more risers and a number of anchor lines, for releasably attaching the risers and anchor lines in a turret of a hull of a vessel, by means of a mooring buoy system, and wherein the buoy comprises a buoyant body, carrying the one or more risers, which extend to a subsea hydrocarbon well, and a number of anchor lines, having an anchor line connector connected to the buoyant body on one end and a seabed connection on their other end; and a reconnection wire which runs through a channel coinciding with a center line of the buoyant body, and is connected to each of the anchor lines, at a connection point at some distance from the anchor line connectors, through anchor line connection sections, and which comprises a stopper and winch wire connection arrangement on the other end, situated on the opposite side of the buoyant body from where the anchor line connectors are located, comprising the steps of:

attaching a winch wire from a turret mooring system of the vessel to the reconnection wire of the mooring buoy system, when the buoy is in an equilibrium state in which the buoyancy of the buoyant body being equal to a mass of the buoyant body plus a suspended weight of the one or more risers and a pulling force of the anchor lines;

pulling in the winch wire, resulting in the reconnection wire pulling directly onto the anchor lines, through the center of the buoyant body, such that a section of the anchor lines between the reconnection wire connection and the anchor line connector becomes slack, reducing the suspended weight on the buoyant body;

reeling in of the winch wire such that the anchor line section between the connection point and the anchor line connector remains slack, allowing the buoyant body carrying the one or more risers to float upwards using the buoyancy force of the buoyant body only.

9. The method according to claim 8, whereby the velocity of the reeling in of the winch wire directly controls the buoy rise-up.

10. The method for attaching one or more risers in a cavity of a turret of a vessel's hull, through use of a method according to claim 9, comprising the steps of:

pulling up the one or more risers, whereby the reeling in of the winch wire continues until the buoyant body is received in the turret structure;

locking in of the buoyant body inside a cavity of the turret structure;

releasing the reconnection wire, such that it forms a slack below the buoyant body where it is connected to the anchor lines and the slack is removed from the section of the anchor lines between the reconnection wire connection and the anchor line connector.

11. The method for attaching one or more risers in a cavity of a turret of a vessel's hull, through use of a method according to claim 8, comprising the steps of:

pulling up the one or more risers, whereby the reeling in of the winch wire continues until the buoyant body is received in the turret structure;

locking in of the buoyant body inside a cavity of the turret structure;

releasing the reconnection wire, such that it forms a slack below the buoyant body where it is connected to the anchor lines and the slack is removed from the section of the anchor lines between the reconnection wire connection and the anchor line connector.

12. A vessel for offshore operations and comprising a turret mooring system, wherein the turret mooring system is configured for use of the method in accordance with claim 8.

13. A method for manufacturing a mooring buoy comprising the steps of:

providing a buoyant body, comprising a through channel in the buoyant body coinciding with a center line of the buoyant body;

installing a number of anchor line connectors on a transverse side to the through channel;

installing one or more riser connectors on the side comprising the anchor line connectors;

installing a reconnection wire through the through channel of the buoyant body, whereby the reconnection wire contains an equal number of wires to the number of anchor line connectors on the reconnection wire extremity exiting the buoyant body on the side having the anchor line connectors attached, and a stopper and winch wire connector arrangement is installed on the opposite extremity of the reconnection wire.

14. The method for manufacturing a mooring buoy according to claim 13, further comprising the step of manufacturing the buoyant body and providing a through channel in the buoyant body coinciding with a center line of the buoyant body.

* * * * *